US012588758B2

(12) United States Patent
Smith et al.

(10) Patent No.: US 12,588,758 B2
(45) Date of Patent: Mar. 31, 2026

(54) RACK SHELF SYSTEMS AND METHOD FOR LOADING PAYLOADS INTO A RACK SHELF SYSTEM

(71) Applicant: Textron Innovations Inc., Providence, RI (US)

(72) Inventors: Gavin Thomas Smith, Wichita, KS (US); Jim Michael Dugan, Conway Springs, KS (US); William Dale George, Andover, KS (US); James Arthur Knittel, Bel Aire, KS (US); Jonathan Swartz, El Dorado, KS (US)

(73) Assignee: TEXTRON INNOVATIONS INC., Providence, RI (US)

( * ) Notice: Subject to any disclaimer, the term of this patent is extended or adjusted under 35 U.S.C. 154(b) by 51 days.

(21) Appl. No.: 18/508,810

(22) Filed: Nov. 14, 2023

(65) Prior Publication Data

US 2025/0151901 A1 May 15, 2025

(51) Int. Cl.
*A47B 88/90* (2017.01)
*A47B 88/407* (2017.01)

(52) U.S. Cl.
CPC ..... *A47B 88/90* (2017.01); *A47B 88/407* (2017.01)

(58) Field of Classification Search
CPC ..... A47B 88/43; A47B 88/90; A47B 88/407
USPC ..... 312/330.1
See application file for complete search history.

(56) References Cited

U.S. PATENT DOCUMENTS 5,749,481 A * 5/1998 Miller ..... A47B 47/021 211/187
6,021,909 A * 2/2000 Tang ..... H05K 7/1421 211/183
6,173,848 B1 * 1/2001 Bravo ..... H05K 7/1425 211/187
6,450,350 B1 * 9/2002 Krummell, Jr. ..... A47B 47/027 211/183
6,600,665 B2 * 7/2003 Lauchner ..... H05K 7/1491 361/825
6,622,873 B2 * 9/2003 Hegrenes ..... H05K 7/183 211/187
6,739,682 B2 * 5/2004 Shih ..... H05K 7/1421 312/334.4
7,866,488 B2 * 1/2011 Mimlitch, III ..... A47B 47/024 211/26
7,930,812 B2 * 4/2011 Curnalia ..... H05K 7/1489 211/183
7,975,860 B2 * 7/2011 Dittus ..... H05K 7/1489 211/207

(Continued)

FOREIGN PATENT DOCUMENTS

CN 108255260 A * 7/2018 ..... G06F 1/182

*Primary Examiner* — Eret C McNichols
(74) *Attorney, Agent, or Firm* — SLATER MATSIL, LLP

(57) ABSTRACT

In an embodiment a tray includes a base area having a top side, a bottom side, a rear end, peripheral sides and a front end, a plurality of flanges extending upward from the top side and arranged at the rear end and the peripheral sides, a pin, bolt or stud arranged at an outside of a flange arranged at the rear end or a hole arranged in the flange at the rear end configured to receive a pin, bolt or stud, a first plurality of restraining rings arranged at a first side flange at the first peripheral side and a second plurality of restraining rings arranged at a second side flange at the second peripheral side.

20 Claims, 9 Drawing Sheets

(56) References Cited

U.S. PATENT DOCUMENTS

| | | | | |
|---|---|---|---|---|
| 8,358,502 | B2 * | 1/2013 | Gomez | H05K 7/1489 248/183.3 |
| 8,562,086 | B1 * | 10/2013 | Baik | A47B 88/931 312/334.4 |
| 8,701,902 | B2 * | 4/2014 | Oura | H05K 7/1421 312/334.3 |
| 8,727,138 | B2 * | 5/2014 | Dittus | H05K 7/183 312/334.4 |
| 9,107,322 | B2 * | 8/2015 | Chuang | H05K 7/1489 |
| 9,155,220 | B2 * | 10/2015 | Yokosawa | H05K 7/183 |
| 9,258,923 | B2 * | 2/2016 | Chen | H05K 7/1489 |
| 9,402,470 | B2 * | 8/2016 | Shen | A47B 97/00 |
| 9,635,937 | B2 * | 5/2017 | Shen | A47B 97/00 |
| 9,648,771 | B1 * | 5/2017 | Markowski | H05K 7/1401 |
| 9,743,767 | B1 * | 8/2017 | Easton | A47B 88/43 |
| 10,028,406 | B2 * | 7/2018 | Chen | H05K 7/1489 |
| 10,104,799 | B2 * | 10/2018 | Shearman | H05K 7/1489 |
| 10,182,651 | B2 * | 1/2019 | Jost | A47B 96/06 |
| 10,327,351 | B2 * | 6/2019 | McGraw | H05K 7/1489 |
| 10,980,144 | B2 * | 4/2021 | Chen | H05K 7/1491 |
| 11,026,509 | B2 * | 6/2021 | Walker | A47B 47/0083 |
| 11,553,791 | B2 * | 1/2023 | Briosi | A47B 96/1441 |
| 12,055,169 | B2 * | 8/2024 | Chen | H05K 7/1489 |
| 12,200,894 | B2 * | 1/2025 | Halliday | H05K 7/1489 |
| 2002/0043508 | A1 * | 4/2002 | Lewis | A47B 57/44 211/208 |
| 2006/0144809 | A1 * | 7/2006 | Collins | A47B 57/406 211/191 |
| 2009/0261051 | A1 * | 10/2009 | Dittus | H05K 7/1489 211/207 |
| 2010/0200523 | A1 * | 8/2010 | Henderson | H05K 7/18 211/26 |
| 2011/0058339 | A1 * | 3/2011 | Le | H05K 7/1489 361/724 |
| 2015/0122752 | A1 * | 5/2015 | Shen | A47B 45/00 211/26 |
| 2020/0037462 | A1 * | 1/2020 | Chen | H05K 7/1491 |

* cited by examiner

RACK SHELF SYSTEMS AND METHOD FOR LOADING PAYLOADS INTO A RACK SHELF SYSTEM

TECHNICAL FIELD

The present invention relates generally to a rack shelf system and method for operating the rack shelf system, and, in particular embodiments, to a standardized aerospace rack shelf system and a method for operating the same.

BACKGROUND

Requirements for loading equipment may change throughout the lifecycle of an aircraft particularly for special missions aircrafts or aircrafts carrying test or experimental equipment. Accordingly, equipment racks, shelves, mounting trays and fasteners have to be frequently changed and modified to accommodate the new or different requirements.

SUMMARY

In accordance with an embodiment a tray includes a base area having a top side, a bottom side, a rear end, peripheral sides and a front end, a plurality of flanges extending upward from the top side and arranged at the rear end and the peripheral sides, a pin, bolt or stud arranged at an outside of a flange arranged at the rear end or a hole arranged in the flange at the rear end configured to receive a pin, bolt or stud, a first plurality of restraining rings arranged at a first side flange at the first peripheral side and a second plurality of restraining rings arranged at a second side flange at the second peripheral side.

In accordance with an embodiment a method for loading mounting trays in a standardized rack shelf system comprising a plurality of rail assemblies for receiving the mounting trays, the rail assemblies all having the same width, is disclosed. The method includes fastening a payload on a mounting tray via straps and restraining rings fixed to side surfaces of the mounting tray, sliding the mounting tray into a respective rail assembly of the plurality of rail assemblies of the standardized rack shelf system so that a pin, bolt or stud mates with a respective hole and securing the mounting tray to the rail assembly via fastening a second equipment support to a first rail and a second rail of the rail assembly so that the mounting tray is secured to the rail assembly and the standardized rack shelf system on all four sides.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF ILLUSTRATIVE EMBODIMENT

Current loading equipment for loading cargo or freight to an aviation vehicle such as an aircraft or a drone need to be frequently modified or changed to accommodate payloads of different sizes, weights or mounting characteristics.

Embodiments provide a standardized rack shelf system that accommodates payloads with different form factors in a single system. The standardized rack shelf system comprises several columns in which a plurality of rail assemblies can be stacked. The rail assemblies can be loaded with mounting trays carrying fixed payloads with different form factors. The mounting trays can be securely fastened to the rail assemblies and to the rack shelf system. The rail assemblies may all have the same size and dimensions and the mounting trays may all have the same size and dimensions.

This advantageously provides a uniform rack shelf system and a method for loading such a system and removes the different requirements for racks, shelfs, mounting trays and fasteners of conventional systems making material requirements and loading of the shelf system easier and simpler.

Figure 1A:
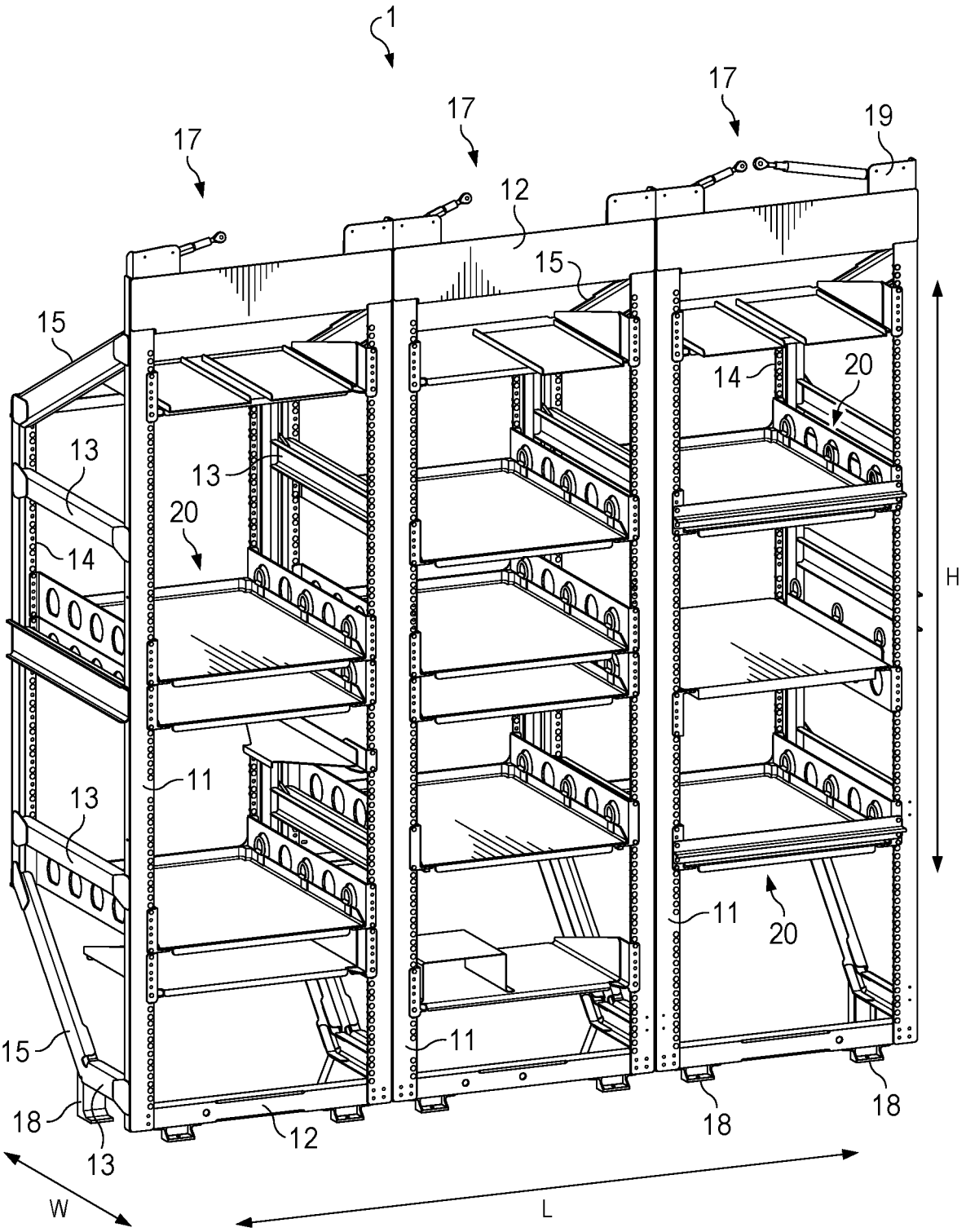
FIG. 1A shows a front perspective view of a standardized rack shelf system configured to be fastened to a storage compartment of an aviation vehicle according to embodiments.

FIG. 1A shows a front perspective view of a rack shelf system 1 configured to be fastened to a storage compartment or cargo hold of an aviation vehicle. The rack shelf system 1 comprises a plurality of first vertical support members 11 extending along a direction H, a plurality of second vertical support members 14 also extending along the direction H, a plurality of first horizontal support members 12 extending along a direction L, a plurality of second horizontal support members 16 extending also along the direction L (see FIG. 1B) and a plurality of third horizontal support members 13 extending along a direction W. The rack shelf system 1 may have additional support members or strut members 15 in directions H, L or W, or even in directions different to the directions of H, L and W. The directions H, L and W may be orthogonal to each other. The support members 11-16 are connected to each other so that they form a sturdy rack shelf system 1. The support members 11-16 may be made from metal such as aluminum.

The support members 11-16 may have different or the same lengths and/or widths. For example, the first vertical support members 11 may be longer than the second vertical support members 14 (but having the same widths), the first horizontal support members 12 may have different widths but the same lengths among each other and may have different widths and the same lengths with respect to the second horizontal support members 15.

The rack shelf system 1 can be releasably fixed to a storage compartment or a cargo hold of an aviation vehicle via a plurality of bottom mounts 18 connected to a bottom first horizontal support member 12 or integrated in this support member 12. Additional bottom mounts 18 may be arranged at the rack shelf system 1, e.g., via strut member 16. Moreover, the rack shelf system 1 can be further releasably fixed to the storage compartment or another rack shelf system 1 via top mounts 19 arranged at a top first horizontal support member 12 or integrated in this support member 12, and/or via a seat track.

The first vertical support members 11 of the rack shelf system 1 are equidistantly spaced apart from each other so that a space or a distance between two neighboring first vertical support members 11 in direction L is always the same. For example, the rack shelf system 1 may have 4 or 6 first and second vertical support members 11, 14 and 2 first and second horizontal support members 12, 15 (e.g., per column 17) thereby providing 3 columns 17 in which (standardized) rail assemblies 20 can be arranged. The rack shelf system 1 may have only two first horizontal support members 12 per column 17 and the columns 17 may all have the same dimension for placing the rail assemblies (in H, W and L). Several rail assemblies 20 such as 2, 3, 4, 5 or 6 rail assemblies 20 may be arranged on top of each other in one column 17. The rail assemblies 20 can be releasably fixed to neighboring first and second vertical support members 11, 14. The rail assemblies 20 are configured to receive the mounting shelfs 60. Embodiments of the rail assemblies 20 and the mounting shelfs 60 are described in more detail in FIGS. 2A-2C.

Figure 1B:
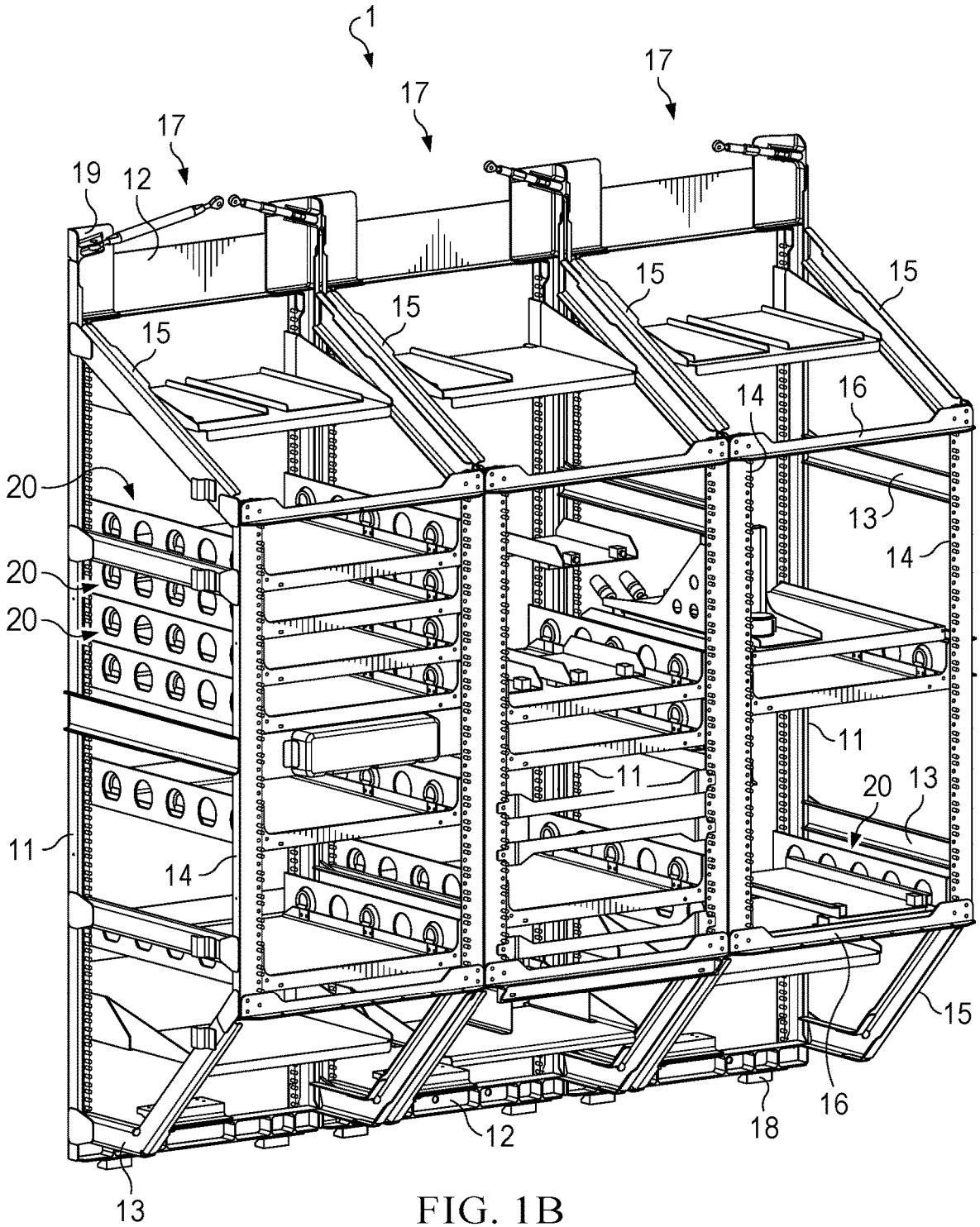
FIG. 1B shows a rear perspective view of a standardized rack shelf system configured to be fastened to a storage compartment of an aviation vehicle according to embodiments.

FIG. 1B shows a rear perspective view of a rack shelf system 1 similar to the one in FIG. 1A. The configuration of the rack shelf systems 1 of FIGS. 1A and 1B with rail assemblies 20 is different. For example, the embodiment of FIG. 1B shows 6 rail assemblies 20 stacked on top of each other in the left column 17, 2 rail assemblies 20 stacked on top of each other in the middle column 17 and 2 rail assemblies 20 stacked on top of each other in the right column 17. Various other configurations of rail assemblies 20 in the rack shelf system 1 are possible.

Figure 2A:
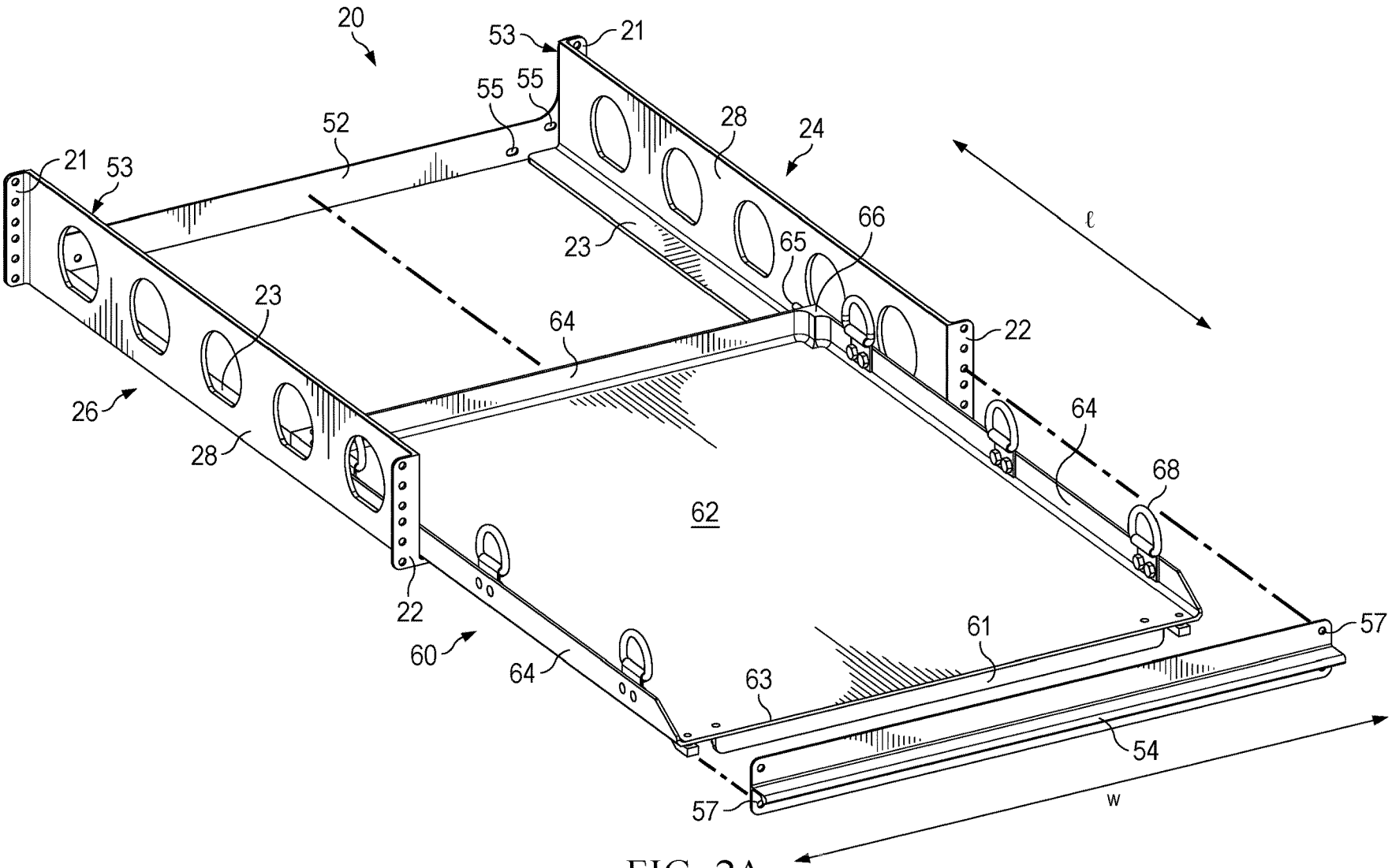
FIG. 2A shows a rail assembly and a respective mounting tray to be moved or slid into the rail assembly according to embodiments.

FIG. 2A shows a rail assembly 20 and a respective mounting tray 60 to be moved or slid into the rail assembly 20. The rail assembly 20 comprises a first rail 24 and a second rail 26 extending in a length direction 1. Each of the first rail 24 and the second rail 26 may be made from metal (e.g., aluminum) and comprises a metal plate 28, a rear flange 21, a front flange 22 and a guiding flange 23. The metal plate 28 may comprise a plurality of holes. Each flange 21-23 and the metal plate 28 may form a L so that the first and the second rails 24, 26 may have a multi-dimensional L form. The first and second rails 24, 26 may be arranged in mirror fashion so that the guiding flanges 23 face each other and the rear flanges 21 and the front flanges 22 face away from each other.

The first rail 24 and the second rail 26 are connected to each other at a rear end by a first equipment support 52. The first equipment support 52 is a metal (e.g., aluminum) piece that extends in a width direction w of the rail assembly 20. The equipment support 52 may be a bar or beam. For example, the bar or beam may have the form of a T beam being flat on all ends. The upper (horizontal) bar of the T may be longer than the vertical bar of the T. The T beam may have a groove or slit in the horizontal bar where it meets the vertical bar of the T. The groove or slit may be configured to receive a rear end of the shelf 60. The equipment support 52 may have two holes 53 on each end of the bar 52 so that it can be releasably fixed to the first rail 24 and the second rail 26 by fasteners or fixing means 40 such as screws, clips or brackets. In particular the equipment support 52 may be screwed to the rear flanges 21 of the first and second rail 24, 26 as seen in FIG. 2C. At the same time the equipment support 52 may be screwed to the rear flanges 21 of the rails 24, 26 and to two neighboring first vertical support members 11.

The first equipment support 52 may further comprise holes 55 configured to receive pins, bolts or studs 65 of the mounting tray 60. The holes 55 may be arranged on each end of the bar 52. For example, one hole 55 is arranged on each end of the bar 52. Alternatively, only one single hole 55 may be arranged at the bar 52 or a plurality of holes (more than 2 such as 3 or 4) may be equidistantly distributed along the length of the bar 52 (i.e., length w). The holes 55 are arranged between the holes 53 for fixing the equipment support 52 to the rail assembly 20.

Alternatively, the first equipment support 52 may comprise the pins, bolts or studs and the mounting tray 60 may comprise the discussed respective holes configured to receive the pins, bolts or studs. The pins, bolts or studs may be distributed in a similar way as the holes 55 discussed in the previous paragraph.

The first rail 24 and the second rail 26 may be connected to each other at the front end by a second equipment support 54 after the mounting tray 60 is placed in the assembly rail 20. The equipment support 54 is a metal (e.g., aluminum) piece that extends in a width direction w of the rail assembly 20. The equipment support 54 may be a bar or beam. For example, the bar or beam may have the form of a T beam being flat on all ends. The upper (horizontal) bar of the T may be longer than the vertical bar of the T. The T beam may have a groove or slit in the horizontal bar where it meets the vertical bar of the T. The groove or slit may be configured to receive a front end 63 of the shelf 60 (similar to the previously discussed rear end). The equipment support 54 may have two holes 57 on each end of the bar 54 so that it can be releasably fixed to the first rail 24 and the second rail 26 by fasteners or fixing means such as screws, clips or brackets (see FIG. 2C). In particular the equipment support 54 may be screwed to the front flanges 22 of the first and second rail 24, 26 At the same time the equipment support 54 may be screwed to the front flanges 22 the rails 24, 26 and to two neighboring first vertical support members 11.

The second equipment support 54 may not have any further holes configured to receive pins, bolts or studs 65 of the mounting tray 60 or the respective pins, bolts or studs. Alternatively, the second equipment support 54 may have further holes/pins similar to those described with respect to the first equipment support 52. The second equipment support 54 may only be fixed to the rail assembly 20 and/or the rack shelf system 1 after the mounting tray 60 is placed on, or moved or slid into the rail assembly 20. Moreover, the second equipment support 54 may be taken off the rail assembly 20 and/or the rack shelf system 1 before the mounting tray 60 is removed from or taken out the rail assembly 20.

The mounting tray 60 comprises a base area 62 such as a flat plate. The base area or plate 62 may be square or rectangular and may be of metal such aluminum. Flanges (sometimes referred to side surfaces) 64 are provided along sides of the upper surface of the base area 62. The flanges 64 may extend orthogonally away from the base area or plate 62. The flanges 64 may be arranged at three sides of the base area 62 but not on the fourth side. For example, the flanges 64 may be arranged at opposite peripheral sides and at the rear side but not at the front side. All flanges 64 may have the same heights. Alternatively, the flanges 64 may have different heights so that the peripheral flanges are higher than the rear flange. The rear flange 64 may be connected via strengthened structures, e.g., strengthened corners 66, to the flanges 64. The strengthening corners 66 may be a cube or a rectangular prism.

The rear flange 64 may comprise a pin, bolt or stud 65 at its rear side (or, alternatively, as discussed supra with respect to the first equipment support 52 respective holes). The pin 65 may mate with the respective hole(s) 55 of the first support equipment 52 when the tray 60 is properly slid in the rail assembly 20. The pin(s) 65/hole(s) 55 combination advantageously provides a tight and secure fixation of the mounting tray 60 to the rack shelf system 1 so that the payload fixed on the mounting tray 60 is properly secured during flight. The mounting tray 60 may be additionally secured with 2 fasteners to the first and second rails 24, 26 or with 2 fasteners to each of the first and second rails 24, 26.

Metal (e.g., aluminum) rings 68 may be placed at the side flanges 64. The rings 68 may be equidistantly placed along the side flanges 64. Alternatively, they may be randomly placed at the side flanges 64. 3 rings may be placed on each side. However, other number of rings such as 2 or 4, 5, 6 or even more rings can be placed there. The same number of rings 68 may be placed on each side of the tray 60. The rings 68 may be (releasably) fixed to the side flanges 64 by fasteners or fixing means such as clips, screws, clamps or (soldered) rivets. Alternatively, the rings 68 may be an integral part of the side flanges 64 and cannot be separated therefrom. In a specific embodiment, holes are integrated (as rings) in the side flanges 64 providing the function of the rings. In some embodiments, rings 68 may also be placed at the rear flange 64 so that they are placed at three flanges 64. In yet another embodiment, rings 68 may be placed at the front of the tray 60, e.g., at the support 54. This can lead to rings being placed on all 4 sides of the tray 60, only on 3 sides of the tray 60 (front and sides) or only on 2 sides of the tray 60 (front and rear).

The rings 68 may be rotatable restraining rings, i.e., an upper part of the ring 68 is rotatable and adjustable along the length direction 1 of the mounting tray 60. For example, the rings 68 may be D rings. The rotatable restraining rings 68 are adjustable to different sizes of payloads so that the payloads can be optimally strapped as disclosed with respect to FIGS. 4A-4C.

The mounting tray 60 may further comprise an elongated extension 61 on an underside (e.g., a lower surface) of the base area or plate 62. The elongated extension 61 may extend along the width direction w and may reinforce the tray 60 therefore providing a sturdy mounting tray 60. Alternatively, the elongated extension 61 may form an X at the underside of the base area or plate 62.

The mounting tray 60 may further comprise (a) layer(s) at an underside of the base area or plate 62. For example, the tray 60 may comprises layer(s) on each side of the base area or plate 62 in a length direction 1. The layer(s) are configured to reduce friction between the tray 60 and the rail assembly 20 so that the mounting tray 60 effortlessly slidable in and out of the rail assembly 20. The layers may reduce friction by 10-50%, 20-40%, or alternatively, by 25-35% relative to mounting trays without such friction reduction layers. The layers may be Teflon layers. For example, there is one or a plurality of layers on each side of the underside of the base area or plate 60 facing the guiding flanges 23 of the first and second rails 24, 26.

Figure 2B:
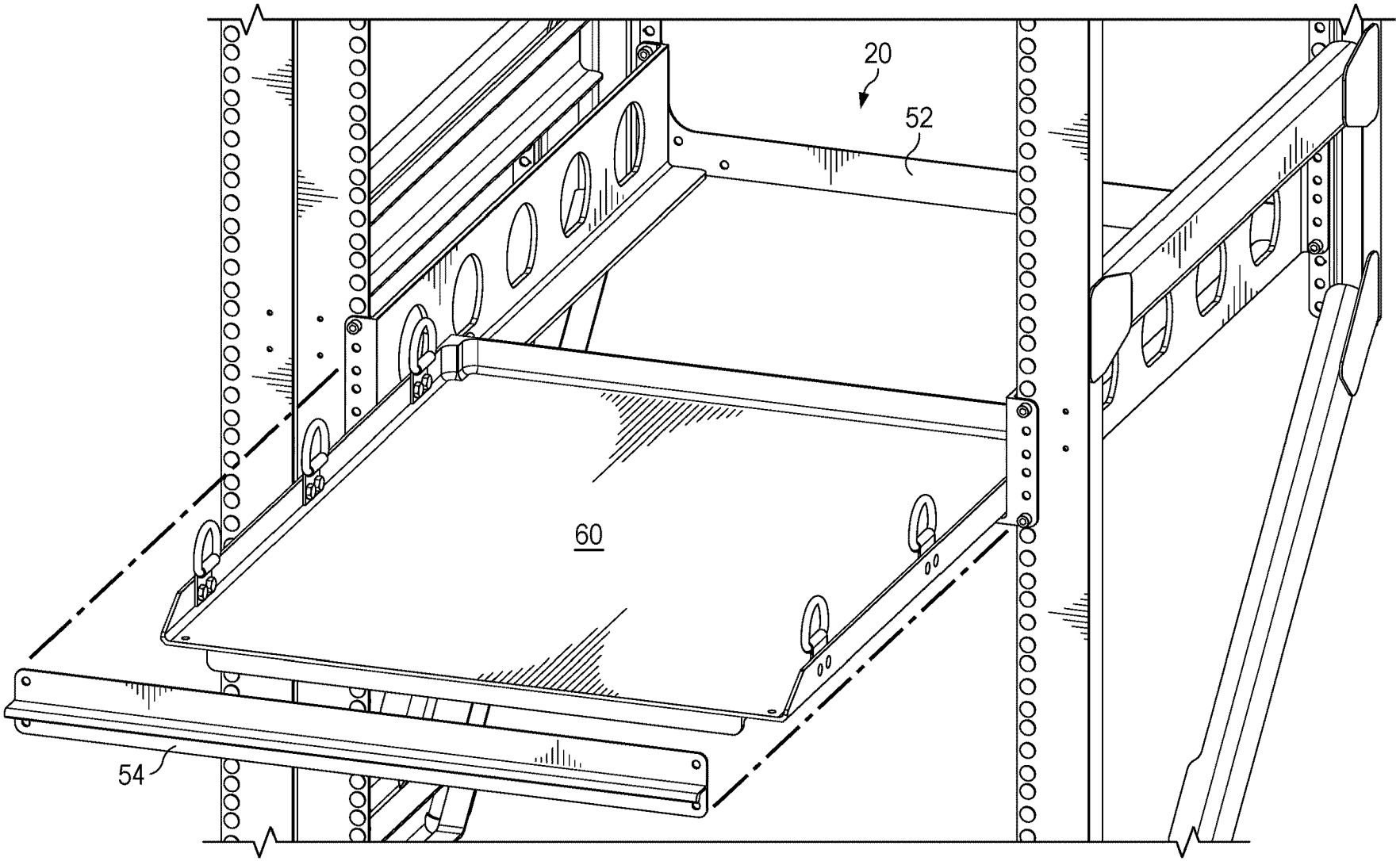
FIG. 2B shows a rail assembly and a respective mounting tray to be moved or slid into the rail assembly, the rail assembly being arranged in a rack shelf assembly according to embodiments.
Figure 2C:
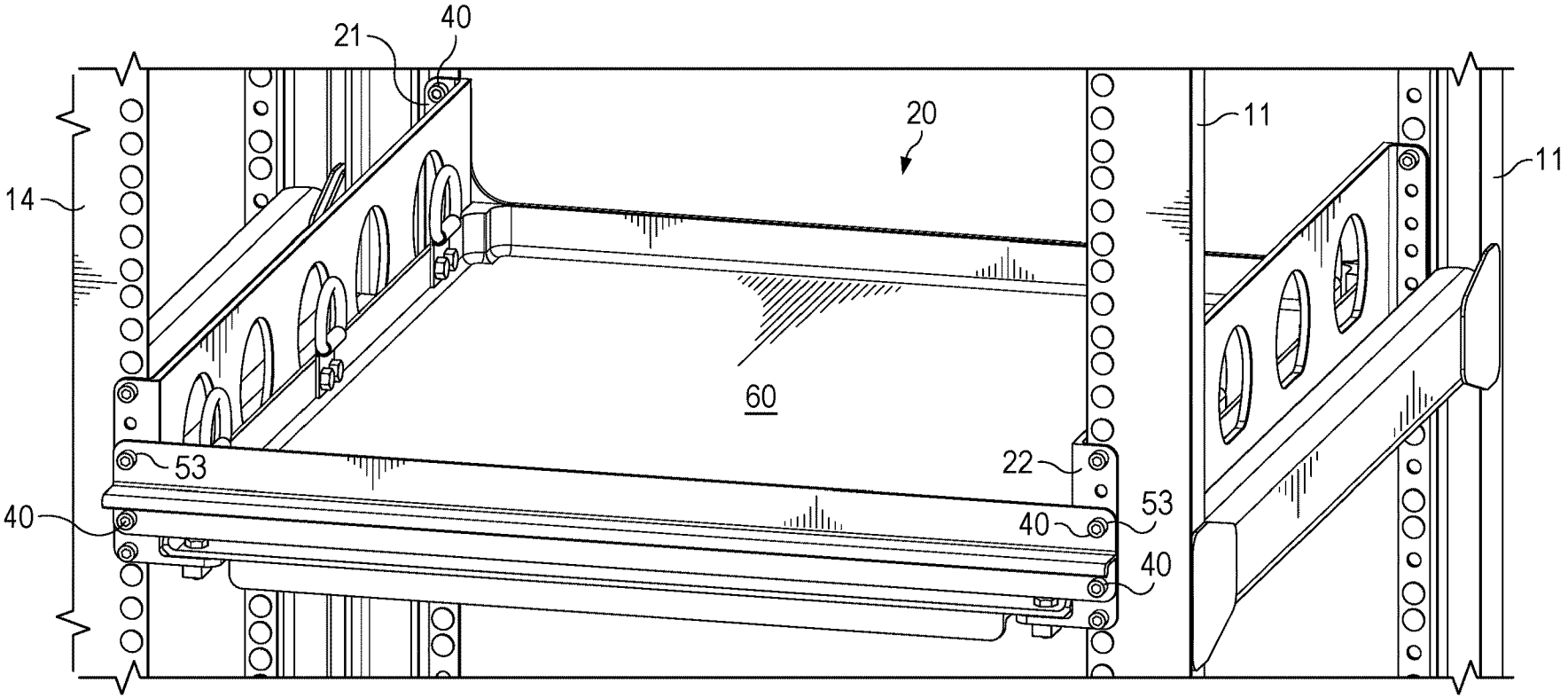
FIG. 2C shows a front perspective view of a mounting tray fixed to the rail assembly and/or rack shelf system according to embodiments.

FIG. 2B shows how the tray 60 is slide into the rail assembly 20 arranged in the rack shelf system 1. After the tray 60 is completely moved in the rail assembly 20 so that pin, bolt or stud 65 mates with the hole 55 of the first equipment support 52, the second equipment support 54 is fixed to the first vertical support members 14 of the rack shelf system 1 so that the mounting tray 60 (with the payload) is securely fastened on all sides in the rack shelf system 1. An embodiment how the first equipment support 52 and the rail assembly 20 is fixed to the rack shelf system is shown in FIG. 2C.

Figure 3:
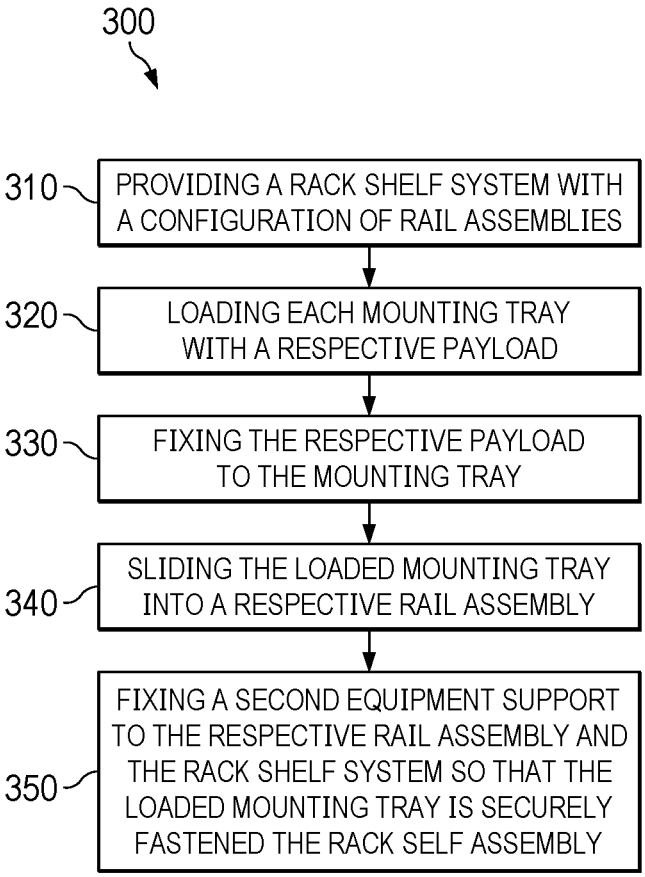
FIG. 3 shows a method for loading a payload onto the rack shelf system.

A method 300 for loading trays with payloads having different form factors on a rack shelf system is discussed with respect to FIG. 3. The method comprises providing, at 310, a rack shelf system, e.g., a rack shelf system 1, and a plurality of rail assemblies, e.g., rail assemblies 20, (removably) arranged to the rack shelf system. The rail assemblies 20 may all be the same. The rack shelf system can be configured with the rail assemblies in various configurations, e.g., as shown in FIG. 1A or 1B. At 320, loading each mounting tray (e.g., tray 60) with a respective payload and, at 330, fixing the payload via straps and restraining rings to the mounting tray, as shown, for example in FIGS. 4A-4C. At 340, moving or sliding the mounting tray (with or without the payload) into a respective rail assembly (see, e.g., FIGS. 2A and 2B). After the tray is completely slid in so that the pin, bolt or stud and the respective hole are mate, at 350, fixing the second equipment support to the rail assembly and/or the rack shelf system via fasteners or fixing means such as screws, clips or brackets. The second equipment support fixes the tray to the rail assembly and/or the rack shelf system so that the mounting tray is securely fastened on all sides as shown in FIG. 2C.

In various embodiments the reverse process is applied to unload the payload from the rack shelf system. In other words, the second equipment support is removed (e.g., unscrewed) from the rail assembly and the rack shelf system, then the mounting tray (with or without a respective payload) is taken out from the rail assembly and then the payload is unstrapped from the respective mounting tray.

Figure 4A:
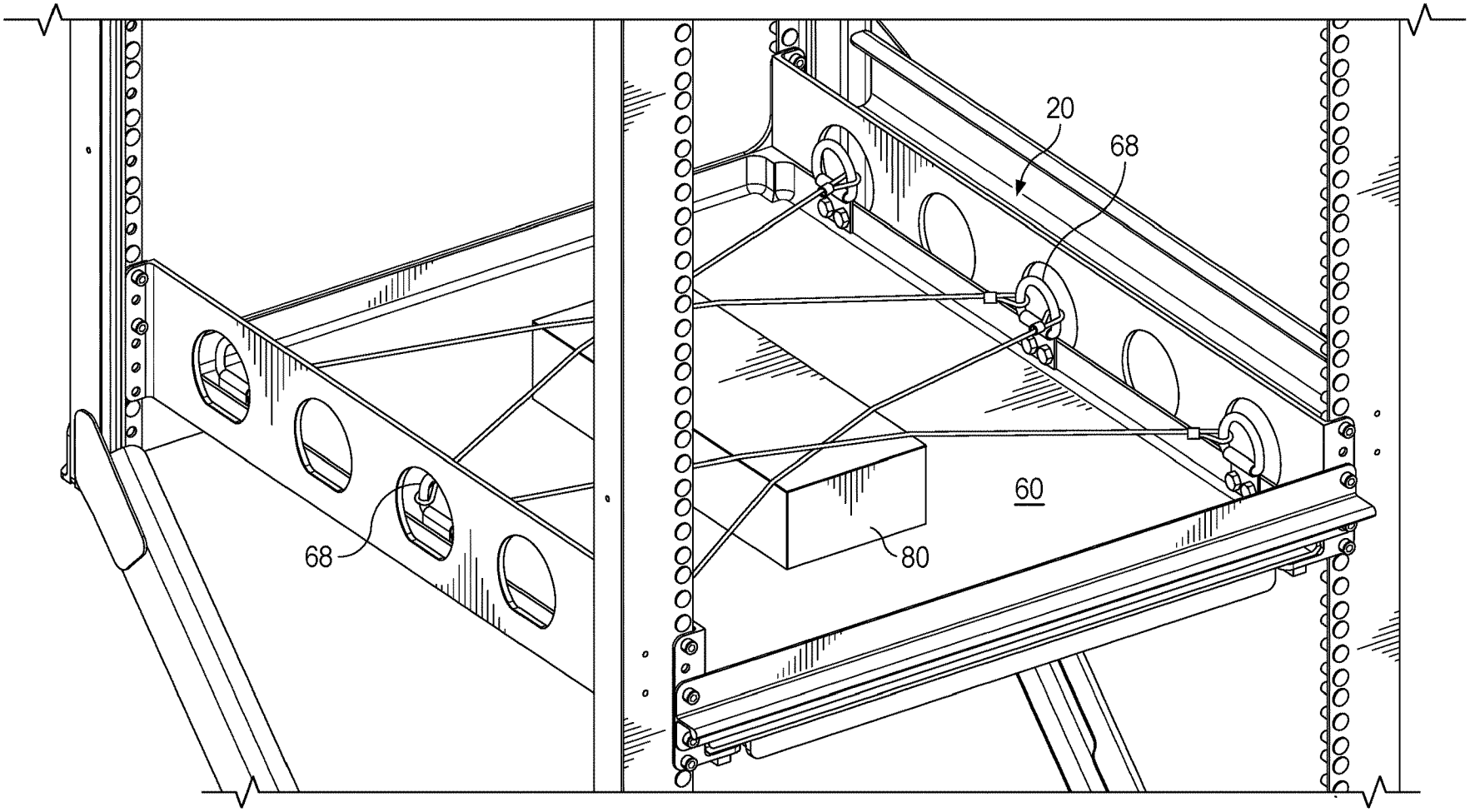
FIGS. 4A-4C show payloads with different form factors fixed to the standardized rack shelf system.
Figure 4B:
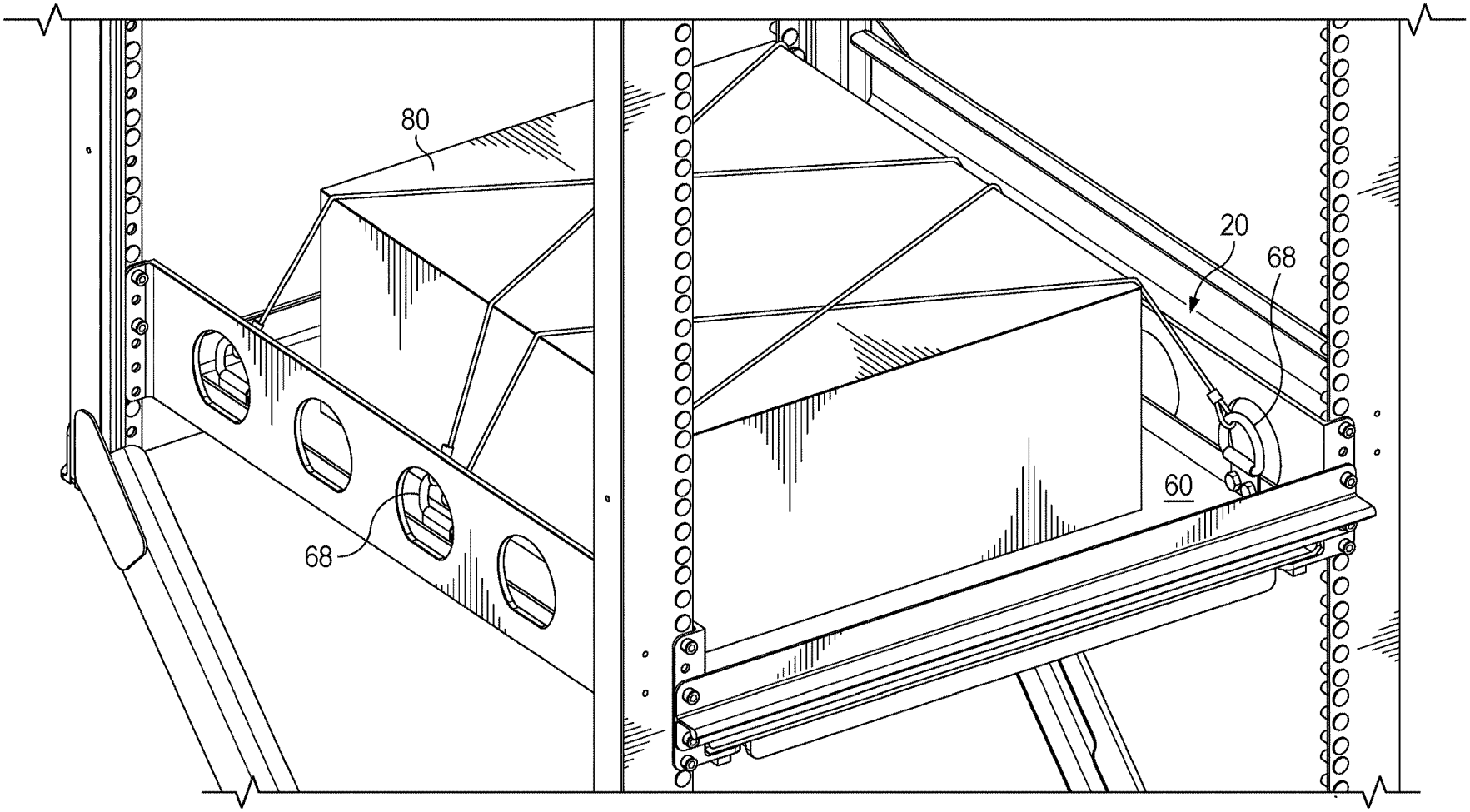
Figure 4C:
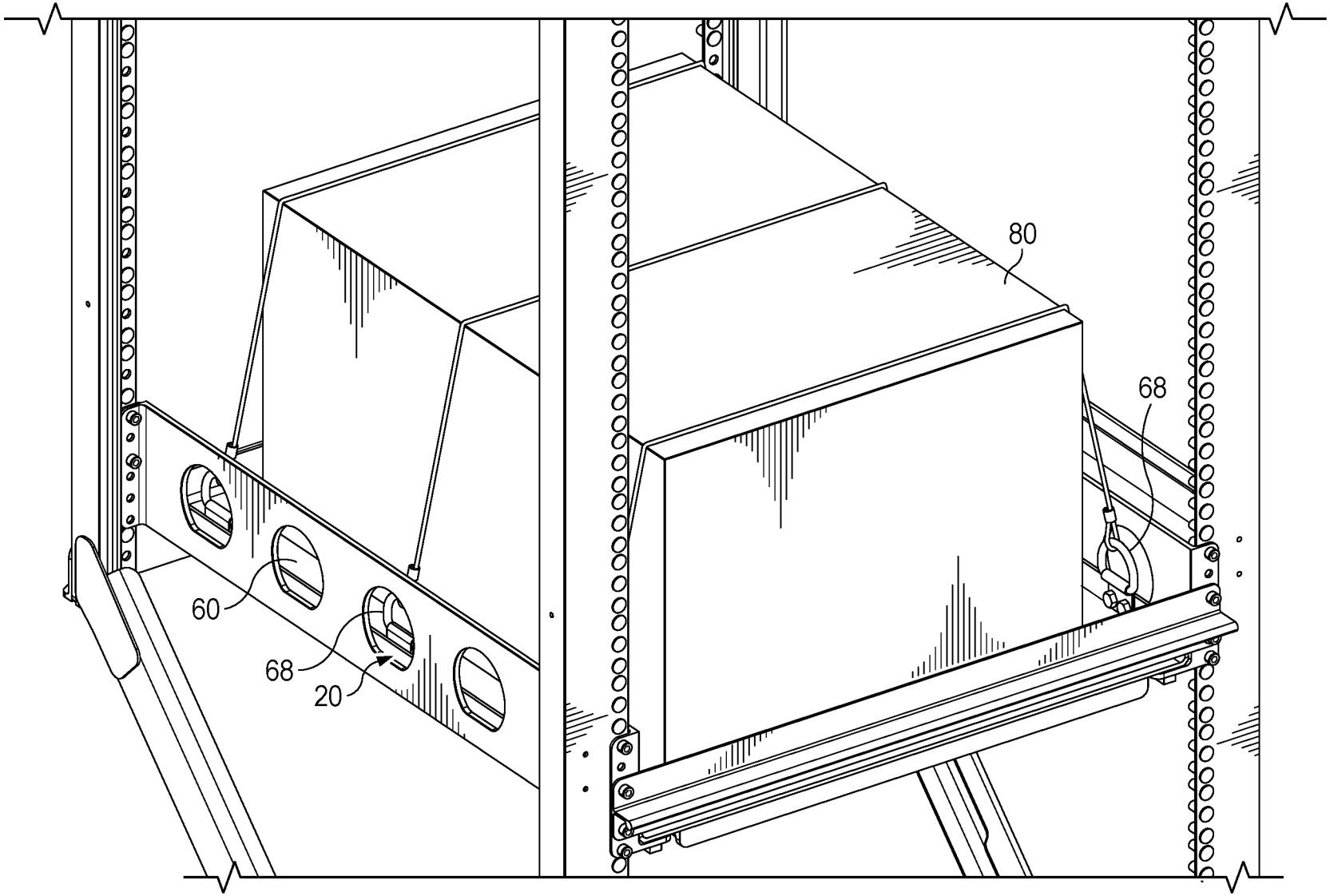

FIG. 4A-4C show payloads 80 with different form factors and sizes strapped to the mounting trays 60 via restraining rings 68. The restraining rings 68 may pivot downward to optimally fasten the respective payloads 80. The mounting trays 60 all have the same size and dimensions, and the rail assemblies 20 all have the same size and dimensions.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A rail assembly comprising:

a first rail comprising a first front flange, a first rear flange and a first guiding flange;

a second rail comprising a second front flange, a second rear flange and a second guiding flange, wherein the first rail and the second rail are arranged such that the first and second guiding flanges face each other, and wherein the first rear flange and the second rear flange face away from each other; and a first equipment support connecting the first rear flange with the second rear flange, wherein the rail assembly is configured to receive a tray, the tray comprising:

a base area having a top side, a bottom side, a rear end, peripheral sides and a front end;

a plurality of flanges extending upward from the top side and arranged at the rear end and the peripheral sides;

a pin, bolt or stud arranged at an outside of a flange arranged at the rear end or a hole arranged in the flange at the rear end configured to receive the pin, bolt or stud;

a first plurality of restraining rings arranged at a first side flange at a first peripheral side; and a second plurality of restraining rings arranged at a second side flange at a second peripheral side.

2. The rail assembly of claim 1, wherein the first front flange and the second front flange face away from each other.

3. The rail assembly of claim 2, further comprising a second equipment support connecting the first and second front flanges.

4. The rail assembly of claim 3, wherein each of the first and second equipment supports is a T bar.

5. A rack shelf system comprising:

first vertical support members extending in a first direction;

second vertical support members extending in the first direction, the second vertical support members being shorter than the first vertical support members;

first horizontal support members extending in a second direction orthogonal to the first direction;

second horizontal support members extending in the second direction; and third horizontal support members extending in a third direction orthogonal to the first and second directions, wherein the third horizontal support members connect a first vertical support member to a respective second vertical support member, wherein the first and second vertical support members are equidistantly spaced apart and connected by the first and second horizontal support members, wherein the first and second vertical support members and the first to third horizontal support members form a column, wherein a plurality of rail assemblies are stacked in the column, each rail assembly of the plurality of rail assemblies being the rail assembly of claim 1, wherein the first vertical support members are directly connected to each other only by a bottom horizontal support member of the first horizontal support members and a top horizontal support member of the first horizontal support members, wherein the bottom horizontal support member is connected to mounts, and wherein the mounts are configured to be releasably connected to an aviation vehicle cargo floor.

6. The rack shelf system according to claim 5, wherein the top horizontal support member is configured to be releasably fixed to an aviation vehicle cargo side wall or to a top horizontal support member of another rack shelf system.

7. An apparatus, comprising:

a first rail comprising a first front flange, a first rear flange and a first guiding flange;

a second rail comprising a second front flange, a second rear flange and a second guiding flange, wherein the first rail and the second rail are arranged such that the first and second guiding flanges face each other, and wherein the first rear flange and the second rear flange face away from each other; and a first equipment support connecting the first rear flange with the second rear flange, a tray removably disposed between the first rail and the second rail.

8. The apparatus of claim 7, wherein the tray further comprises:

a base area having a top side, a bottom side, a rear end, peripheral sides and a front end; and a plurality of flanges extending upward from the top side and arranged at the rear end and the peripheral sides.

9. The apparatus of claim 7, wherein the tray further comprises:

a pin, bolt or stud arranged at an outside of a flange arranged at the rear end;

wherein the first equipment support has a hole disposed therein and that is configured to accept the pin, bolt or stud.

10. The apparatus of claim 7, wherein the tray further comprises:

a first plurality of restraining rings arranged at a first side flange at a first peripheral side; and a second plurality of restraining rings arranged at a second side flange at a second peripheral side.

11. The apparatus of claim 10, wherein the tray comprises a plurality of friction reducing layers, wherein at least one first friction reducing layer is arranged at a bottom side and at the first peripheral side, and wherein at least one second friction reducing layer is arranged at the bottom side and at the second peripheral side.

12. The apparatus of claim 11, wherein the tray further comprises an elongated extension arranged at the bottom side.

13. The apparatus of claim 12, wherein the elongated extension is arranged at a front end.

14. The apparatus of claim 7, wherein the first front flange and the second front flange face away from each other.

15. The apparatus of claim 7, further comprising a second equipment support connecting the first and second front flanges.

16. The apparatus of claim 15, wherein each of the first equipment supports is a T bar and wherein the second equipment support is a T bar.

17. An apparatus, comprising:

first vertical support members extending in a first direction;

second vertical support members extending in the first direction, the second vertical support members being shorter than the first vertical support members;

first horizontal support members extending in a second direction orthogonal to the first direction;

second horizontal support members extending in the second direction;

third horizontal support members extending in a third direction orthogonal to the first and second directions, wherein the first vertical support members, the second vertical support members, the first horizontal support members, the second horizontal support members, and third horizontal support members are arranged to form a column; and a plurality of rail assemblies, wherein the plurality of rail assemblies is stacked in the column, and wherein each rail assembly of the plurality of rail assemblies comprises:

a first rail comprising a first front flange, a first rear flange and a first guiding flange;

a second rail comprising a second front flange, a second rear flange and a second guiding flange, wherein the first rail and the second rail are arranged such that the first and second guiding flanges face each other, and wherein the first rear flange and the second rear flange face away from each other; and a first equipment support connecting the first rear flange with the second rear flange, a tray removably disposed between the first rail and the second rail;

wherein the third horizontal support members connect a first vertical support member to a respective second vertical support member;

wherein the first and second vertical support members are equidistantly spaced apart and connected by the first and second horizontal support members;

wherein the first vertical support members are directly connected to each other only by a bottom horizontal support member of the first horizontal support members and a top horizontal support member of the first horizontal support members;

wherein the bottom horizontal support member is connected to mounts; and wherein the mounts are configured to be releasably connected to an aviation vehicle cargo floor.

18. The apparatus of claim 17, wherein the tray of each rail assembly of the plurality of rail assemblies further comprises:

a base area having a top side, a bottom side, a rear end, peripheral sides and a front end; and a plurality of flanges extending upward from the top side and arranged at the rear end and the peripheral sides;

a pin, bolt or stud arranged at an outside of a flange arranged at the rear end, wherein the first equipment support of the respective rail assembly has a hole disposed therein and that is configured to accept the pin, bolt or stud;

a first plurality of restraining rings arranged at a first side flange at a first peripheral side; and a second plurality of restraining rings arranged at a second side flange at a second peripheral side.

19. The apparatus of claim 17, wherein, in each rail assembly of the plurality of rail assemblies, the first front flange and the second front flange face away from each other.

20. The apparatus of claim 17, wherein each rail assembly of the plurality of rail assemblies further comprises a second equipment support connecting the first and second front flanges.

* * * * *